United States Patent [19]

Scholtze et al.

[11] 4,252,179

[45] Feb. 24, 1981

[54] DEVICE FOR WITHDRAWING A METAL INGOT FROM THE MOULD OF A CONTINUOUS CASTING UNIT

[75] Inventors: Karl-Ernst Scholtze, Schwarzach; Ernst Linsinger, Goldegg, both of Austria

[73] Assignee: Swiss Aluminium Ltd., Chippis, Switzerland

[21] Appl. No.: 65,194

[22] Filed: Aug. 9, 1979

[30] Foreign Application Priority Data

Aug. 24, 1978 [CH] Switzerland ..... 8980/78

[51] Int. Cl.[3] ..... B22D 11/08

[52] U.S. Cl. ..... 164/446; 164/426; 164/440

[58] Field of Search ..... 164/425, 426, 445, 446, 164/82

[56] References Cited

U.S. PATENT DOCUMENTS 4,211,275 7/1980 Morianz ..... 164/440

*Primary Examiner*—Robert D. Baldwin
*Assistant Examiner*—K. Y. Lin
*Attorney, Agent, or Firm*—Bachman and La Pointe

[57] ABSTRACT

In a continuous casting system, a starter block for withdrawing a metal strand from a casting mold is provided with a bolt which is readily releasable from the metal block. The bolt is provided with a conical head having a threaded surface which projects out from the end face of the starter block and is cast into the metal strand. After casting of the metal strand, the starter block is uncoupled from the bolt and the bolt is rotatably removed from the metal strand. The starter block can then be reused.

10 Claims, 4 Drawing Figures

DEVICE FOR WITHDRAWING A METAL INGOT FROM THE MOULD OF A CONTINUOUS CASTING UNIT

BACKGROUND OF THE INVENTION

The present invention is drawn to a device for withdrawing a metal ingot from the mold of a continuous casting system by means of a pulling facility which is attached to a starter block or the like and is partly surrounded by the casted strand.

At the state of casting in a continuous casting system, in particular in the case of so called horizontal continuous casting machines, the metal strand is usually engaged by a split screw cast into the ingot and then pulled out of the mold by said screw. This method suffers from a number of disadvantages, one being that the quality of the starting end of the ingot is poor due to the screw which remains in the end and therefore is unusable. The end pieces can only be remelted. In addition a new pulling facility is needed for the start of each casting. Also, it has been found that the split screws frequently break resulting in the ingot coming to a standstill which causes a delay in the casting process.

Therefore, it is the principal object of the present invention to develop a device for withdrawing a metal strand from a mold wherein, the pulling facility can be removed from the ingot without leaving any residue, and can be used again. It is a further object of the present invention to provide a pulling facility which requires little time for installation and therefore eliminate the danger of interruption of casting due to the above mentioned fracture of the screw. Another object of the present invention is to provide a pulling facility which exhibits a long service life and which is relatively maintainance free.

SUMMARY OF THE INVENTION

The foregoing objects are readily achieved by way of the present invention wherein a pulling facility is in the form of a bolt which can be readily freed from the starter block. The bolt is provided with a conical shaped head which projects from the end face of the starter block towards the metal strand. The conical shaped head narrows away from the starter block and is provided a thread which is cast into the metal strand. The thread, in accordance with the present invention, be a round thread. However, the conical head is provided preferably with a sawtooth shaped thread. The conical head is enveloped by molten metal and, because of the thread, is locked in by the solifified metal producing a strong connection which is able to bear a tensile force sufficient to remove the metal strand. After pulling out the metal strand, the starter-block is detached from the bolt and the bolt is removed from the metal strand by rotating it to free the thread from the strand. The bolt can then be used again even for different ingot formats.

In order to achieve better positioning of the metal strand on the starter block, the block is provided on its free end facing the strand with a ring-shaped collar.

It is particularly advantageous to provide a two part version of the starting bolt, one end of the shaft of which broadens to form a conical end piece and the other end is provided with an axial threaded hole to accommodate an adjusting or tightening screw.

At least part of the outer surface of the conical end piece of the bolt rests on the starting block and prevents the bolt being moved from its central positon by the inflowing metal. At the end face of the end piece there is, in accordance with the present invention, the conical head which if desired can be mounted releasably in the shaft of the starting bolt.

To avoid a sudden change over of the conical head, which tapers in the direction of the strand being cast into the outer face of the conical piece which tapers in the opposite direction, the diameter of the face of the end piece is larger than the diameter of the neighboring conical head. This results in a ring shaped surface or shoulder round the conical head.

At the other end of the shaft, in its threaded bore, there is an adjusting or securing bolt the head of which serves as a stop for a bayonet locking facility. The screw thus forms a connecting piece in a quick locking facility while, at the same time allows the seating of the bolt in the starter block to be adjusted.

The withdrawal system of the present invention can be used both in horizontal continuous casting and in vertical continuous casting, indepedent of the metal being cast whether steel, copper, aluminium and other non-ferrous metals.

BRIEF DESCRIPTION OF THE DRAWINGS

Further advantages, features and details of the present invention will be made apparent from a consideration of the drawings wherein, FIG. 1. Is a partly sectional longitudinal view of equipment for horizontal casting with a starter block.

DETAILED DESCRIPTION

Figure 1:
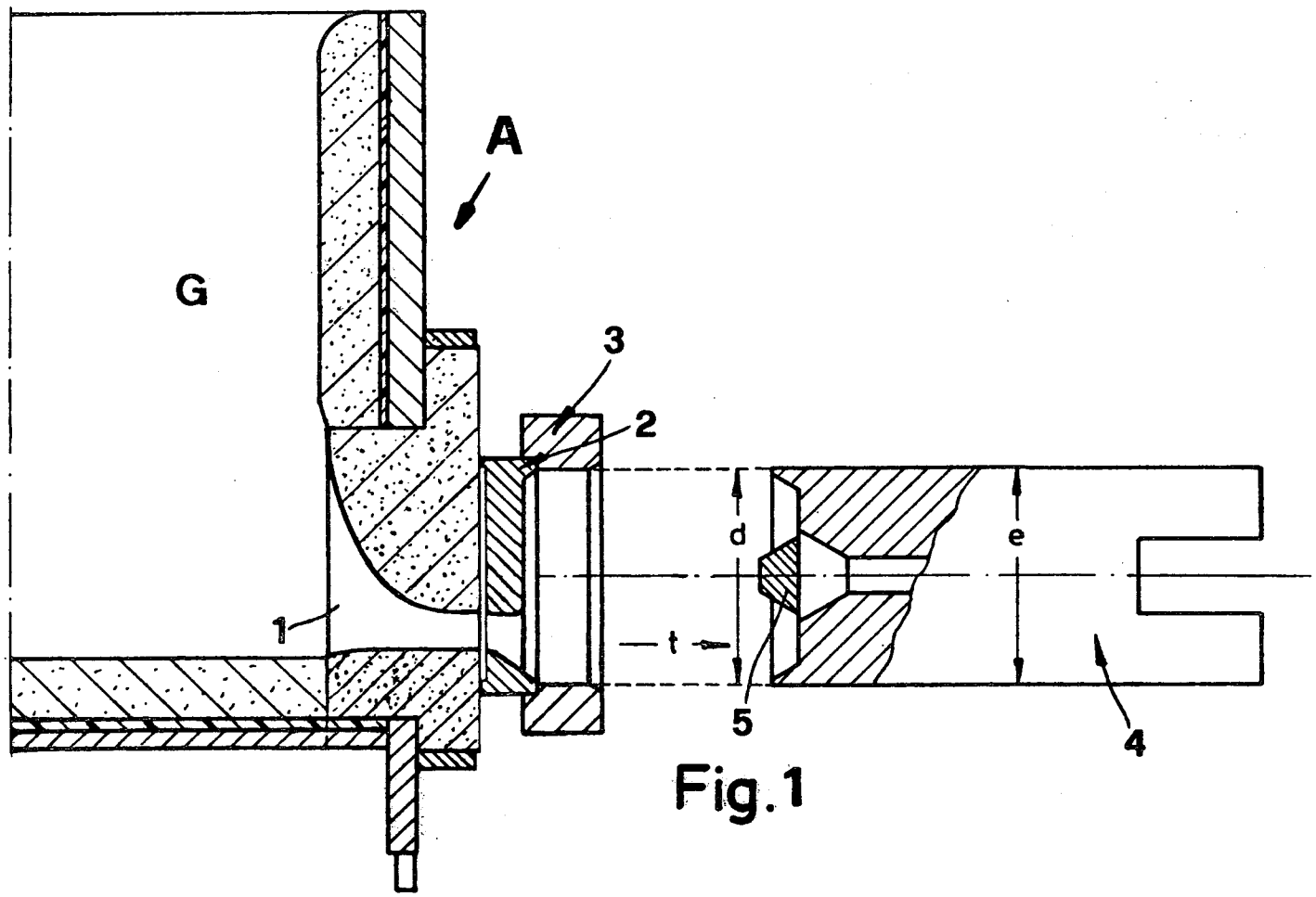
Figure 2:
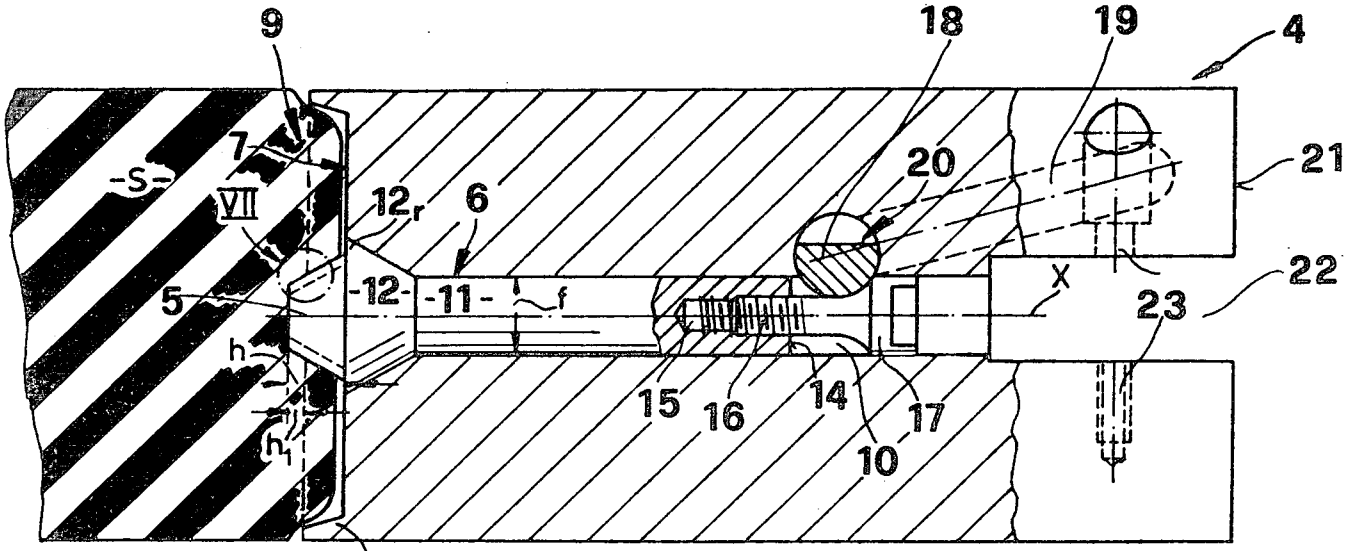
FIG. 2. Is an end view of the starter block, shown partly sectioned and enlarged.

Equipment A for the horizontal casting of ingots features a crucible G with outlet or outlets 1.

A mold 3 is positioned downstream of the nozzle in the casting direction t.

The height d of the exit opening of the mold is for example 22 mm. The height determines the thickness e of the starter block 4, which is introduced into the exit opening of the mold before casting commences by means of a bar or bolt 6 which has a conical head 5 pointing in the direction counter to the casting direction t.

The starter block 4 is pushed into the mold 3 in such a way that on pouring of the metal, for example steel, Cu, Mg or Al, the metal flows around the conical head 5 of the puller or starting bolt 6 and reaches approximately the end face 7 of the starter block 4. After the metal has solidified the strand S is securely attacked to the thread 8 on the conical head 5.

The strand of metal S can then be drawn out of the mold 3 with the help of the starter block 4. The reusable puller bolt 6 is uncoupled from the start 9 of the metal strand S simply by rotating the said bolt 6 in spite of the shrinkage of the metal.

The bolt 6 residing in a hole 10 in the starter block 4 comprises a conical head 5 with thread 8, a shaft 11 of uniform diameter f (e.g. 30 mm) which increases at one end to form a conical end piece 12. The conical head 5 and the end piece 12 are releaseably attached and form a ring shaped shoulder 12*r*.

The conical head 5 projects a distance h of 22 mm out from the end face 7 of the starter block 4 and a distance $h_1$, of approx 10 mm beyond a ring shaped collar 13 which surrounds the end face 7 of the starter block. An adjusting or fixing bolt 16 is introduced into a central threaded hole 15 in the other end 14 of the shaft 11. A part 18 of a locking lever 19 rests on the shaft side of the head 17 of the bolt 16 and serves as a quick-release bayonet locking facility 20 between the bolt 6 and the starter block.

At the end 21 of the starter block remote from the strand S there is a slit 22 with a recess 23, which runs perpendicular to the axis X of the bolt 6 and accommodates a connecting device for a facility (not shown here) for actuating the starter block.

Figure 3:
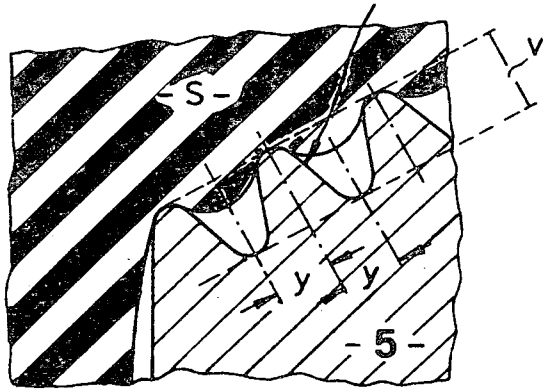
FIG. 3. Is a detail from FIG. 2 corresponding to the area VII and enlarged.
Figure 4:
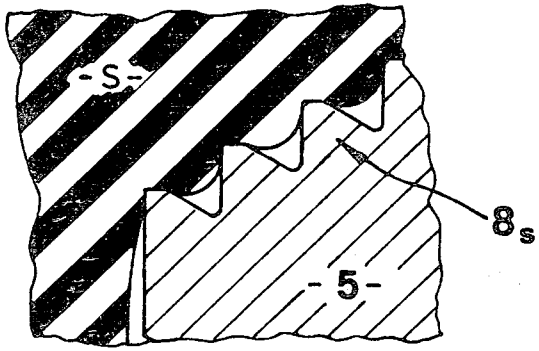
FIG. 4. Is a view of another version of the part shown in FIG. 3.

The round toothed thread 8 on the conical head 5, shown in FIG. 3, is of depth equal to approx 6.5 mm and has a pitel Y of 9 mm. The saw tooth thread 8s in FIG. 4 is more defined and provides better keying to the strand.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is

1. An apparatus for withdrawing a metal strand from the mold of a casting unit comprising a starter block having first and second end faces and a through bore extending from said first end face to said second end face, bolt means releasably secured within said bore, said bolt being provided on the free end thereof facing said metal strand with a conical head tapering toward said metal strand, said conical head being provided with threads on which said metal strand is cast.

2. An apparatus according to claim 1 wherein said thread on said conical is round toothed.

3. An apparatus according to claim 1 wherein said thread on said conical head is saw toothed.

4. An apparatus according to claim 1 wherein the end face of said starter block facing said metal strand is provided with a ring-shaped collar.

5. An apparatus according to claim 1 wherein said bolt means includes a shaft integral with said conical head, said shaft is provided with a conical end piece adjacent to said conical head and tapering away from said metal strand.

6. An apparatus according to claim 5 wherein said bolt at the other end thereof is provided with a central threaded hole.

7. An apparatus according to claim 5 wherein said conical head is situated on said conical end piece so as to form a shoulder facing said metal strand.

8. An apparatus according to claim 5 wherein the concial head forms a single unitary unit with said conical end piece and said shaft whereby said bolt means can be released from said starter block and can be removed from said metal strand by rotation thereof.

9. An apparatus according to claim 5 wherein said conical head is releasably attached to said conical end piece of said bolt means.

10. An apparatus according to claim 6 wherein said central hole in said bolt is provided with an adjusting screw which acts as a stop for a releasing member on a bayonet locking device.

* * * * *

UNITED STATES PATENT AND TRADEMARK OFFICE

CERTIFICATE OF CORRECTION

PATENT NO. : 4,252,179

DATED : February 24, 1981

INVENTOR(S) : Karl-Ernst Scholtze and Ernst Linsinger

It is certified that error appears in the above-identified patent and that said Letters Patent are hereby corrected as shown below:

Column 1, line 12, change "state" to --start--.

Column 2, line 1, change "positon" to --position--.

Column 4, line 5, claim 2, after "conical" insert --head--.

Column 4, line 24, claim 8, change "concial" to --conical--.

Signed and Sealed this

*Fifth* Day of *May 1981*

[SEAL]

*Attest:*

RENE D. TEGTMEYER

*Attesting Officer* *Acting Commissioner of Patents and Trademarks*